United States Patent [19]

Boss

[11] Patent Number: 4,614,290

[45] Date of Patent: Sep. 30, 1986

[54] SADDLE STITCHING MACHINE FOR SIGNATURES AND THE LIKE

[75] Inventor: Heinz Boss, Strengelbach, Switzerland

[73] Assignee: GRAPHA-HOLDING AG., Hergiswil, Switzerland

[21] Appl. No.: 682,918

[22] Filed: Dec. 18, 1984

[30] Foreign Application Priority Data

Jan. 26, 1984 [CH] Switzerland ..... 362/84

[51] Int. Cl.[4] ..... B21J 15/28; B42C 1/12

[52] U.S. Cl. ..... 227/1; 227/78; 227/81; 227/100; 270/53

[58] Field of Search ..... 227/1, 77, 78, 79, 80, 227/81, 82, 83, 84, 85, 86, 87, 88, 89, 90, 100, 101, 102; 270/53

[56] References Cited

U.S. PATENT DOCUMENTS

| | | | |
|---|---|---|---|
| 775,622 | 11/1904 | Flora | 227/81 |
| 1,608,838 | 11/1926 | Christensen | 227/81 |
| 2,693,595 | 11/1954 | Belluche et al. | 227/100 X |
| 2,999,242 | 9/1961 | Young et al. | 227/78 |
| 4,196,835 | 4/1980 | Schlough | 227/99 X |
| 4,479,642 | 10/1984 | Macey | 227/100 X |

FOREIGN PATENT DOCUMENTS

| | | |
|---|---|---|
| 337177 | 5/1959 | Switzerland . |
| 549443 | 5/1974 | Switzerland . |

*Primary Examiner*—Paul A. Bell
*Attorney, Agent, or Firm*—Peter K. Kontler

[57] ABSTRACT

A saddle stitching machine wherein the pitch of the chain conveyor which transports successive signatures through the stapling station can be changed by changing the ratio of a transmission which receives torque from the timing shaft of the machine. The conveyor transports the signatures along a straight path and the machine has a reciprocable carriage which is moved back and forth along such path by an adjustable crank drive so that the stroke of the carriage can conform to the selected pitch of the conveyor. The tools which are carried by the carriage are actuated by cams which are movable independently of each other at right angles to the straight path. The cams extend in parallelism with the path of signatures at the stapling station.

20 Claims, 4 Drawing Figures

SADDLE STITCHING MACHINE FOR SIGNATURES AND THE LIKE

BACKGROUND OF THE INVENTION

The present invention relates to machines for stapling the sheets of stacks of overlapping sheets to each other, and more particularly to improvements in so-called saddle stitching machines for signatures and the like. Still more particularly, the invention relates to improvements in saddle stitching or saddle-wire stitching machines of the type wherein a conveyor advances successive stacks of sheets along a straight path during each cycle of the machine and a reciprocable carriage supports one or more sets of tools which apply staples to successive stacks and thereupon deform the thus applied staples. The carriage is movable back and forth along the aforementioned straight path.

Saddle stitching machines of the above outlined character are disclosed, for example, in Swiss Pat. No. 337,177. The means for actuating the tools on the carriage includes cams or coulisses which are mounted in the frame of the saddle stitching machine. A drawback of heretofore known machines, including that which is disclosed in Swiss Pat. No. 337,177, is that their output remains unchanged irrespective of the dimensions of signatures or analogous accumulations of overlapping sheets. As a rule, the speed of the conveyor which transports successive signatures to the stitching station does not exceed two meters per second. On the other hand, the capacity of the apparatus (e.g., a gathering machine) which supplies signatures to the conveyor of the saddle stitching machine can be increased well beyond that of the just described stitching machine by the simple expedient of increasing the speed of the rotary drum-shaped gripper therein.

OBJECTS AND SUMMARY OF THE INVENTION

An object of the invention is to provide a novel and improved saddle stitching machine which is constructed and assembled in such a way that its capacity can be varied within a wide range.

Another object of the invention is to provide a machine whose capacity can be varied as a function of the dimensions of signatures or other products which are to be treated therein.

A further object of the invention is to provide a machine wherein the pitch of the conveyor for signatures or like products can be varied in dependency on the dimensions of such products.

An additional object of the invention is to provide the machine with novel and improved means for varying the stroke of the carriage for the staple applying and deforming tools.

Still another object of the invention is to provide a machine of the above outlined character wherein the means for actuating the various tools can be operated independently of one another.

A further object of the invention is to provide a machine which can be rapidly and effortlessly converted from the treatment of larger to the treatment of smaller products or vice versa.

The invention resides in the provision of a cyclically operated saddle-wire stitching machine for the application of wire staples across the folds of a series of signatures or otherwise stacked sheets. The machine comprises a conveyor (e.g., a twin saddle chain) which serves to perform a step during each cycle of the machine and defines an elongated straight (e.g., horizontal) path for advancement of successive groups of sheets, means for driving the conveyor including means for varying the length of steps which are performed by the conveyor during successive cycles, a reciprocable carriage which serves to perform a back-and-forth stroke along the path during each cycle of the machine, means for reciprocating the carriage including means for varying the length of its strokes, staple applying and deforming devices provided on the carriage and being actuatable to drive staples through successive groups of sheets on the conveyor and to thereupon clinch such staples, and means for actuating the staple applying and deforming devices including elongated cams extending longitudinally of the path and means for moving the cams substantially transversely of the path. Such moving means preferably includes means for moving the cams independently of each other.

The moving means can comprise at least one elongated toothed rack on each of the cams and extending at right angles to the path, a gear (e.g., a gear segment) meshing with each rack, and shafts or other suitable means for rotating the gears in clockwise and counterclockwise directions. The rotating means can comprise means for rocking the gear segments back and forth in clockwise and counterclockwise directions. Such rocking means preferably comprises a discrete shaft for each of the gears or for each set of gears serving to move the rack or racks of a cam, and means for rotating each shaft clockwise and counterclockwise. Means can be provided for releasably coupling the gears to the rotating means so that the staple applying and deforming devices need not be actuated when a defective group of sheets is located in the range of such devices.

In accordance with a presently preferred embodiment of the invention, the moving means comprises a pair of spaced-apart elongated parallel toothed racks on each of the cams, gears meshing with such racks, and means for rotating the gears in clockwise and counterclockwise directions. Such rotating means can comprise a discrete shaft for each cam and one of these shafts can be installed in the interior of the other shaft.

The driving means preferably comprises a timing shaft and means (e.g., including a step-up or step-down transmission) for transmitting motion from the timing shaft to the conveyor. The transmission can be removably mounted in the frame of the saddle-wire stitching machine so that it can be replaced with a transmission having a different speed ratio. The driving means can further comprise an intermediate shaft which transmits motion to the conveyor (e.g., through the medium of a sprocket wheel thereon) and the transmission can comprise a second shaft which receives motion from the timing shaft and one or more sets of mating gears or other suitable means for transmitting torque from the second shaft to the intermediate shaft. The intermediate shaft can be mounted on a support (e.g., a plate) which is pivotable about the axis of the second shaft and can be used to actuate a means (such as a normally open electric switch) for interrupting the operation of the driving means. For example, the switch can be mounted in the frame of the machine and the support can be biased against such switch by a coil spring or by other suitable biasing means so as to normally maintain the switch in closed position in which the driving means can be operated to move the conveyor and the groups of sheets thereon during each cycle of the machine.

The means for varying the strokes of the carriage can comprise a variable-throw crank drive which derives motion from the means for driving the conveyor. For example, the crank drive can include a radially adjustable crank pin on a gear which is mounted on the aforementioned second shaft, and a link which connects the crank pin with the carriage. By moving the pin radially of its gear, one can change the throw of the crank drive and hence the length of the back-and-forth strokes of the carriage.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 3, 4:
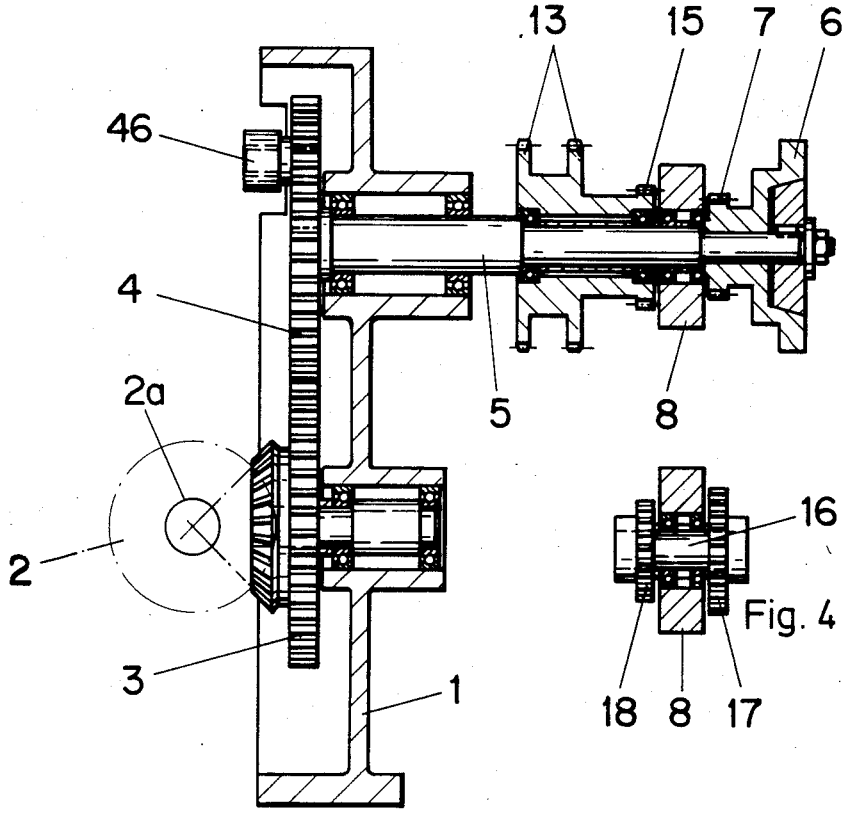
FIG. 3 is an enlarged transverse vertical sectional view as seen in the direction of arrows from the line III—III of FIG. 1.
FIG. 4 is an enlarged fragmentary transverse vertical sectional view as seen in the direction of arrows from the line IV—IV of FIG. 1.

The saddle-wire stitching machine which is shown in the drawing comprises a housing or frame 1 supporting a bevel gear transmission 2 (FIGS. 1 and 3) which receives motion from a timing shaft *2a*. The latter can be driven by the main prime mover to complete one revolution during each cycle of the machine. The output element of the bevel gear transmission 2 drives a spur gear 3 which is in mesh with a spur gear 4 affixed to a shaft 5. The shaft 5 is the input element of the means for driving the endless twin saddle chain conveyor 14 of the machine and is always driven in synchronism with the timing shaft *2a*.

The shaft 5 is non-rotatably connected with (e.g., keyed to) a hand wheel 6 which is formed with an integral gear 7. A plate-like support 8 is pivotable on and about the axis of the shaft 5 and includes a projection or finger 9 which is caused to bear against a stop 10 on the frame 1 and to thereby close an interrupter switch 11 under the action of a coil spring 12 or other suitable (preferably adjustable) biasing means. The switch 11 is normally open (i.e., it exhibits a tendency to open) to thereby interrupt the circuit of the main prime mover of the drive means for the conveyor 14.

The shaft 5 rotatably supports a compound sprocket wheel 13 for the endless chain conveyor 14. The sprocket wheel 13 is formed with an integral gear 15. The gears 7 and 15 are disposed at the opposite sides of the plate-like support 8 which carries an intermediate shaft 16 separably connected with two gears 17 and 18 which respectively mate with the gears 7 and 15. Thus, when the shaft 5 is driven by the gear 4 (i.e., by the timing shaft *2a* through the medium of the bevel gear transmission 2 and gear 3), it can rotate the sprocket wheel 13 through the medium of gears 7, 17, intermediate shaft 16 and gears 18, 15. The intermediate shaft 16 is freely rotatable in antifriction bearings which are provided therefor in the support 8. Additional antifriction bearings are interposed between the sprocket wheel 13 and its gear 15 on the one hand and the shaft 5 on the other hand.

The parts 16 to 18 can be said to constitute a step-down transmission which can drive the chain conveyor 14 in response to rotation of the shaft 5, i.e., in response to rotation of the timing shaft *2a*. The gears 17 and 18 can be detached from the intermediate shaft 16 and replaced with larger or smaller gears to thereby change the ratio of the transmission between the shaft 5 and the chain conveyor 14. This transmission determines the length of steps which are performed by the chain conveyor 14 during successive cycles of the machine. The illustrated step-down transmission can be replaced with a step-up transmission by the simple expedient of replacing the gears 17, 18 with differently dimensioned gears. As a rule, the ratio of the transmission will depend on the selected pitch of the conveyor 14, namely on the number of products which the conveyor 14 can transport per unit of time at a given speed.

The chain conveyor 14 comprises spaced-apart entraining elements in the form of pushers 19. The mutual spacing of neighboring pushers 19 determines the pitch of the conveyor 14. Each pusher 19 can advance a stack 80 (e.g., a signature) of overlapping paper sheets which are to be treated in the improved machine. The arrangement is such that the conveyor 14 advances a fresh stack 80 into a stapling station 20 during each cycle of the machine.

Figure 1:
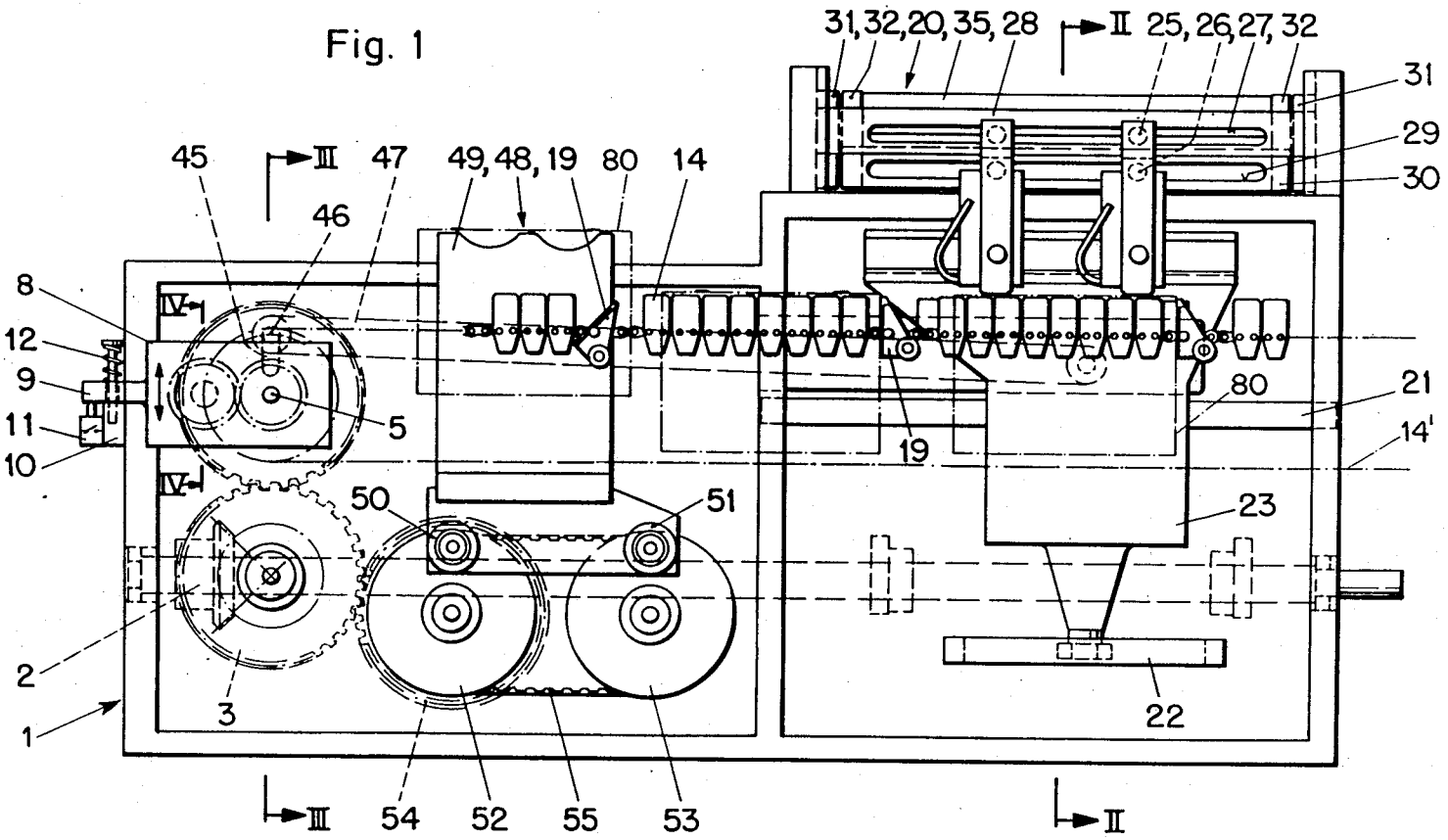
FIG. 1 is a somewhat schematic elevational view of a saddle-wire stitching machine for signatures which embodies one form of the invention.
Figure 2:
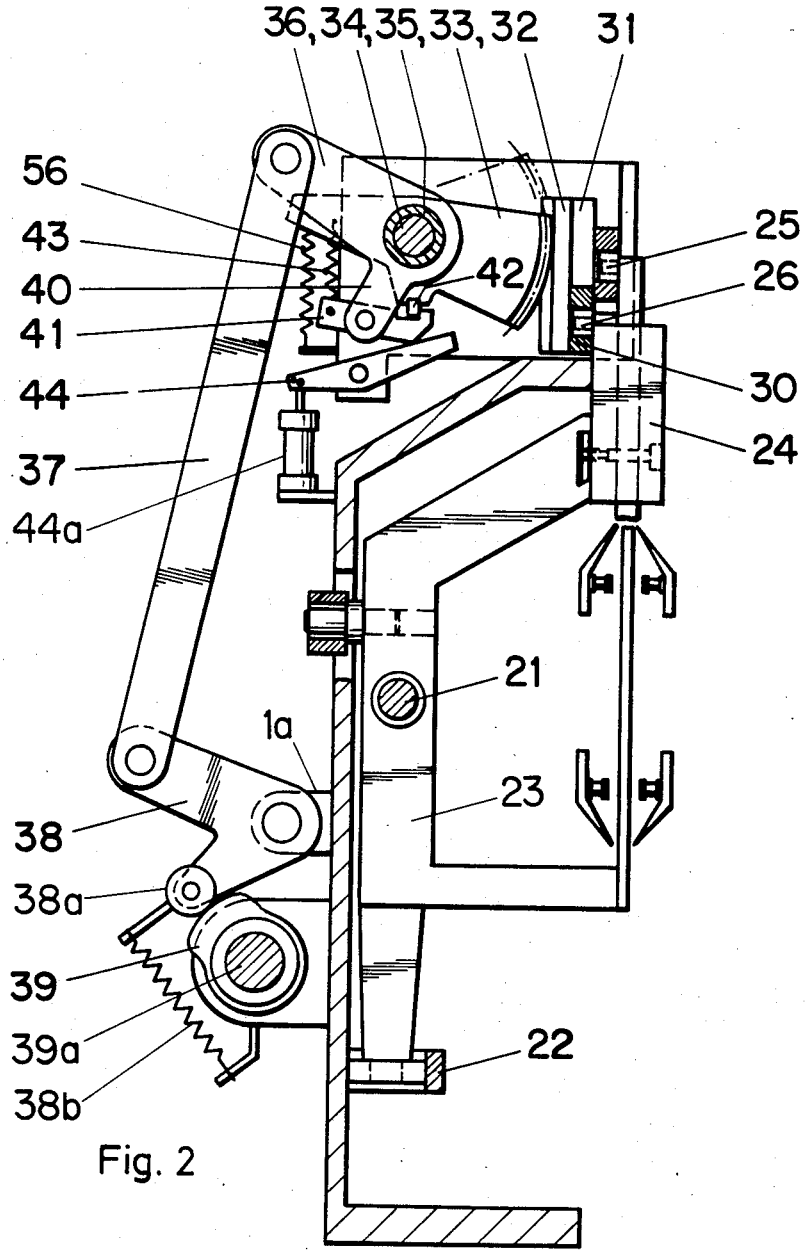
FIG. 2 is an enlarged transverse vertical sectional view of the machine as seen in the direction of arrows from the line II—II of FIG. 1 and shows the carriage, the cams for the wire treating devices on the carriage and the means for moving the cams with reference to the path for the signatures.

The stapling station 20 accommodates two horizontal guides 21 and 22 which are parallel to the adjacent straight path defined by the upper reach of the conveyor 14 for the stacks 80. The lower reach of the conveyor 14 is indicated in FIG. 1 by a phantom line 14'. The purpose of the guides 21 and 22 is to confine a carriage 23 to reciprocatory movements in directions toward and away from the sprocket wheel 13 on the shaft 5. As can be seen in FIG. 2, the guide 22 is located at a level below the guide 21 which latter can constitute an elongated tie rod whose end portions are affixed to the frame 1. The directions of reciprocatory movement of the carriage 23 are parallel to the upper reach of the conveyor 14.

In the embodiment of FIGS. 1 to 4, the carriage 23 supports two staple applying heads 24 each of which can be constructed and assembled in a manner as disclosed, for example, in Swiss Pat. No. 549,443. The tools on each of the heads 24 comprise a staple inserting or driving tool which is actuatable by a follower 26 and a bending or clinching tool which is actuatable by a follower 25. The follower 25 extends into the elongated horizontal cam groove 27 of a first vertically reciprocable cam 28, and the follower 26 extends into an elongated horizontal cam groove 29 of a second vertically reciprocable cam 30. The grooves 27, 29 of the respective cams 28, 30 are parallel to the upper reach of the conveyor 14. The means for moving the cams 28 and 30 at right angles to the elongated horizontal path which is defined by the upper reach of the conveyor 14 comprises a system of elongated toothed racks 31, 32 and gears (here shown as gear segments 33) which mate with the respective toothed racks and cause the corresponding cams 28, 30 to move up and down, i.e., toward and away from the stack 80 of paper sheets at the stapling station 20. The aforementioned tools on the heads 24 are caused to perform their staple inserting and clinching operations in response to vertical movements of the respective cams 28, 30 toward and away from the upper reach of the conveyor 14.

In the illustrated embodiment, one end portion of each of the cams 28, 30 carries a toothed rack 31 and the other end portion of each of these cams carries a second toothed rack 32. A discrete gear segment 33 is in mesh with each of the four toothed racks. FIG. 2 shows the gear segment 33 which is in mesh with the toothed rack 32 at the right-hand end of the cam 30, as viewed in FIG. 1. The means for rotating (actually rocking) the gear segments 33 back and forth (i.e., clockwise and counterclockwise) comprises a first shaft 34 for the gear segments which move the cam 28 and a second shaft 35 (which is hollow and rotatably surrounds the shaft 34) for the gear segments 33 which move the cam 30. The shaft 35 is rotatable on and is also movable axially of the shaft 34, i.e., the cams 28, 30 are movable independently of each other, always at right angles to the elongated path which is defined by the upper reach of the chain conveyor 14 for those stacks 80 which are in the process of advancing toward, which are located at and which are in the process of leaving the stapling station 20.

The means for transmitting torque to the shaft 34 is independent from the means which transmits torque to the shaft 35. FIG. 2 merely shows the torque transmitting means for the shaft 35; such means includes a lever 36 which is rigidly affixed to and extends substantially radially of the shaft 35, a push rod 37 which is articulately connected with the free end of the lever 36, a bell crank lever 38 one arm of which is articulately connected with the adjacent end portion of the connecting rod 37, which is pivotable in a bracket 1*a* of the frame 1 and the other arm of which carries a roller follower 38*a* tracking the peripheral surface of a disc cam 39. The camshaft 39*a* for the cam 39 is driven in synchronism with the timing shaft 2*a* and is rotatably journalled in the frame 1. The shaft 35 for the cam 30 is rocked back and forth once during each revolution of the camshaft 39*a* i.e., the cam 30 is caused to move up and down once during each revolution of the camshaft 39*a*. A coil spring 38*b* is provided to bias the follower 39*a* against the peripheral surface of the cam 39.

The manner in which the shaft 34 is rotated or rocked once back and forth during each cycle of the machine is analogous to that described for the shaft 35. The mutual angular positions of the lobes of the cam 39 on the camshaft 39*a* and on the cam of the camshaft for the shaft 34 are selected with a view to ensure that the tools on the heads 24 which are carried by the carriage 23 are actuated in an optimum sequence for the application of staples to the stack 80 at the stapling station 20.

FIG. 2 further shows a coupling which is installed between the shaft 35 and the corresponding gear segments 33 for the cam 30. Such coupling serves to establish a releasable motion transmitting connection between the shaft 35 and the illustrated gear segment 33; such connection is interrupted when the stapling station 20 receives a defective stack 80. The illustrated coupling comprises a lever 40 which is rigid with the shaft 35, a pawl 41 which is pivotably mounted at the free end of the lever 40, and a stud 42 which is provided on the gear segment 33 and is normally engaged by the pallet of the pawl 41. The pawl 41 is biased in a clockwise direction, as viewed in FIG. 2, by a coil spring 43 so that the pallet of this pawl tends to become disengaged from the stud 42. The spring 43 is normally prevented from pivoting the pawl 41 in a clockwise direction by a lever 44 which is pivotable by an electromagnet 44*a*. The latter receives an impulse when a defective stack 80 is about to enter the stapling station 20 and then causes the lever 44 to pivot clockwise, as viewed in FIG. 2, so that the spring 43 is free to pivot the pallet of the pawl 41 away from engagement with the stud 42. A spring 56 is provided to move the cam 30 to an inoperative position as soon as the electromagnet 44*a* receives a signal to disengage the just described coupling. At such time, the stack 80 can be advanced through the stapling station 20 without the application of one or more staples thereto.

The stroke of the carriage 23 is adjustable. To this end, the carriage 23 is driven by an adjustable crank drive deriving motion from the means for driving the conveyor 14, namely from the gear 4 on the shaft 5. The gear 4 has a radially extending slot 45 for a crank pin 46 which is orbited by the gear 4 about the axis of the shaft 5 and is connected to the adjacent end portion of a connecting rod or link 47 the other end portion of which is coupled to the carriage 23. Thus, by moving the crank pin 46 in the slot 45 (radially of the gear 4), one can change the throw of the crank drive 4, 46, 47 and hence the length of strokes of the carriage 23. The crank pin 46 can be releasably fixed in any one of a practically infinite number of different positions, i.e., at different distances from the axis of the shaft 5).

The stapling station 20 is followed by a lifting or evacuating station 48 where the stacks 80 are removed from the conveyor 14 by a vertically movable sword 49. The latter is movable vertically up and down, as viewed in FIG. 1, by two pins 50, 51 which are eccentrically secured to a pair of discrete wheels 52, 53, respectively. The wheels 52 and 53 are driven in the same direction by a toothed belt 55 receiving motion from a toothed pulley which is coaxial with a spur gear 54 mating with the gear 3. Once a stack 80 is lifted by the sword 49, it is taken over by a further conveyor in a manner not forming part of the present invention.

If the illustrated machine is to be converted to treat different workpieces, i.e., to change the pitch of the conveyor 14, the ratio of the transmission including the intermediate shaft 16 and the gears 17, 18 thereon is changed (e.g., by replacing the entire transmission or by replacing only the gears 17, 18). Furthermore, the operator changes the stroke of the carriage 23 by moving the crank pin 46 in the slot 45 of the gear 4 radially toward or away from the axis of the shaft 5 so that the stroke of the carriage 23 conforms to the freshly selected pitch of the conveyor 14. The RPM of the timing shaft 2*a* is also changed (so as to conform to the rate at which a gathering machine supplies stacks 80 to the upper reach of the conveyor 14) in order to ensure that the chain conveyor 14 is driven at the maximum permissible speed for proper application of staples to successive stacks 80 which are supplied by the gathering machine and arrive seriatim at the stapling station 20.

If the machine is to treat a large batch of identical signatures or like products, e.g., relatively small signatures, it is worthwhile to change the setup of the machine in the aforedescribed manner by changing the transmission ratio between the prime mover and the conveyor 14 and by changing the stroke of the carriage 23 so as to increase the output of the machine accordingly. Thus, the maker of the improved saddle stitching machine can offer a product which can be readily adjusted to conform to the output of the gathering machine which supplies stacks of paper sheets in the form of signatures or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A convertible cyclically operated saddle-wire stitching machine for the application of wire staples across the folds of a series of stacked groups of sheets, comprising a variable-pitch conveyor for accommodating different numbers of groups of sheets, said conveyor defining an elongated straight path for advancement of the groups of sheets; means for driving said conveyor; a reciprocable carriage arranged to perform a back-and-forth stroke along said path during each cycle of the machine; means for reciprocating said carriage, including means for varying the length of said strokes so as to conform the length of said strokes to the selected pitch of said variable-pitch conveyor; staple applying and deforming devices provided on said carriage and actuatable to drive staples through successive groups of sheets on said conveyor and to thereupon clinch such staples; and means for actuating said devices, including elongated cams extending longitudinally of said path and means for moving said cams substantially transversely of said path.

2. The machine of claim 1, wherein said means for varying said strokes includes a variable-throw crank drive.

3. The machine of claim 2, wherein said crank drive derives motion from said driving means.

4. The machine of claim 1, wherein said moving means includes means for moving said cams independently of each other.

5. The machine of claim 1, wherein said moving means comprises a pair of elongated spaced-apart parallel toothed racks provided on each of said cams, gears meshing with said racks, and means for rotating said gears in clockwise and counterclockwise directions.

6. The machine of claim 1, wherein said moving means comprises at least one elongated toothed rack provided on each of said cams, a gear meshing with each of said racks, and means for rotating said gears in clockwise and counterclockwise directions.

7. The machine of claim 6, wherein said gear is a gear segment and said rotating means comprises means for rocking said gear segments in clockwise and counterclockwise directions.

8. The machine of claim 6, wherein said rotating means comprises a discrete shaft for each of said cams.

9. The machine of claim 8, wherein said rotating means further comprising means for rotating each of said shafts in clockwise and counterclockwise directions.

10. The machine of claim 6, further comprising means for releasably coupling said gears to said rotating means.

11. The machine of claim 1, wherein said driving means comprises a timing shaft and means for transmitting motion from said shaft to said conveyor.

12. The machine of claim 11, wherein said motion transmitting means comprises a transmission.

13. The machine of claim 12, wherein said transmission is a step-down transmission.

14. The machine of claim 12, wherein said transmission is a step-up transmission.

15. The machine of claim 12, further comprising a frame and means for removably supporting at least a portion of said transmission in said frame so that said transmission can be replaced with a transmission having a different speed ratio.

16. The machine of claim 15, wherein said transmission is a step-down transmission.

17. The machine of claim 15, wherein said transmission comprises an intermediate shaft arranged to transmit motion to said conveyor, an additional shaft receiving motion from said timing shaft and means for transmitting torque from said additional shaft to said intermediate shaft.

18. The machine of claim 17, further comprising a support for said intermediate shaft, said support being turnable about the axis of said second shaft.

19. The machine of claim 18, further comprising means for interrupting the operation of said driving means and means for biasing said support into engagement with said interrupting means so that the latter permits for operation of said driving means.

20. The machine of claim 19, wherein said interrupting means comprises a normally open switch and said support is arranged to maintain said switch in closed position under the action of said biasing means.

* * * * *